US007359853B2

(12) United States Patent
Holmes

(10) Patent No.: US 7,359,853 B2
(45) Date of Patent: Apr. 15, 2008

(54) METHOD AND SYSTEM FOR LOW BIT RATE VOICE ENCODING AND DECODING APPLICABLE FOR ANY REDUCED BANDWIDTH REQUIREMENTS INCLUDING WIRELESS

(76) Inventor: Clyde Holmes, 3526 Barrington, San Antonio, TX (US) 78217

( * ) Notice: Subject to any disclaimer, the term of this patent is extended or adjusted under 35 U.S.C. 154(b) by 597 days.

(21) Appl. No.: 11/055,912

(22) Filed: Feb. 11, 2005

(65) Prior Publication Data

US 2006/0184359 A1 Aug. 17, 2006

(51) Int. Cl.
*G10L 21/00* (2006.01)

(52) U.S. Cl. ..... 704/201; 341/126

(58) Field of Classification Search ..... None
See application file for complete search history.

(56) References Cited

U.S. PATENT DOCUMENTS 5,838,269 A * 11/1998 Xie ..... 341/139

* cited by examiner

*Primary Examiner*—Abul K. Azad

(57) ABSTRACT

An implementation of the present invention for 4800 bits per second comprises a voice encoder and decoder method and system that uses voice excitation, eliminating the voice/unvoiced pitch tracking, and the first formant up to 2400 Hertz, does not use pulse code modulation encoding, but uses the zero crossings only of the first formant, dividing by two and sampling at 2400 Hertz. The resulting combination uses half of the bit rate for excitation and the remainder for short term spectrum analysis. The spectrum is updated each 20.8 milliseconds using 50 bits per frame. The decoder extracts the excitation, multiplies it by two and uses a Hanning modified sawtooth and spectral flattening to excite the spectrum generator. This waveform produces both even and odd harmonics for both periodic (voiced) and aperiodic (unvoiced) frequencies and gives naturalness to all languages and speakers. The technique for 2400 bits per second utilizes first formant up to 1100 Hertz heterodyning down by 300 Hertz, dividing by tow and sampling at 800 Hertz. The short term power spectrum uses a difference encoding to give a frame of 36 bits which is sent at 44.4 Hertz rate. The demultiplexed excitation is then heterodyned to the original frequency, where it is then used to excite the decoded short term spectrum and the resultant is naturally sounding speech. Both 4800 BPS and 2400 BPS excitation is delayed by one frame before it is used to stimulate the short term power spectrum inverse filters.

18 Claims, 15 Drawing Sheets

EXCITATION ANALYSIS

EXCITATION ANALYSIS

EXCITATION SYNTHESIS

VOCODER TRANSMITTER

VOCODER RECEIVER

VOICE EXCITED CHANNEL VOCODER TRANSMITTER

4800 BITS PER SECOND EXCITATION

CHANNEL VOCODER RECEIVER

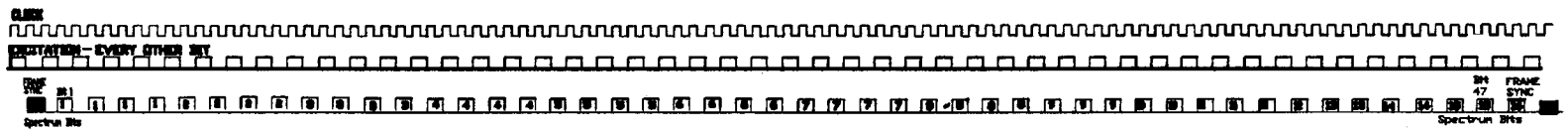

The power spectrum band of frequencies is encoded using 4 bits for the magnitude. Channel 1 through channel 8 use the 4 bits magnitude. Channel 9's magnitude is compared with channel 8 and the difference -3 most significant bits are sent, channels 10, 11, 12, 13, 14, use the difference from the previous channel, and the 2 most significant bits are transmitted. Channels 15 and 16 use only one bit difference to encode the levels.

SPECTRUM GAIN CODING 20 millisecond frame, 1 bit sync, 47 bits spectrum gain = 2400 bits per second
EXCITATION 1/2 bit rate continuous = 2400 bits per second

4800 BITS PER SECOND TIMING

FIGURE 7 (ORIGINAL)

REPLACEMENT SHEET

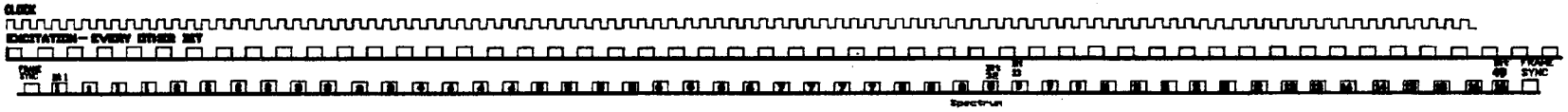

The short term power spectrum frequency bands are encoded using 4 bits for the magnitude. Channel 1 through 8 use the full 4 bits. Channel 9 is compared with channel 8 and the difference, 3 most significant bits are sent, channels 10, 11, 12, 13, 14, 15, and 16 use the difference from the previous channel, and two most significant bits are encoded.

SPECTRUM GAIN CODING 49 bits spectrum + 1 bit frame synchronization = 50 bit frame
Frame Rate is 48 frames per second Frame Rate : frames/second = 50 x 48 = 2400 bits Per Second
EXCITATION 1/2 bit rate continuous = 2400 bits per second

4800 BITS PER SECOND TIMING

FIGURE 7 (REVISED)

THE CHANGES BETWEEN THE ORIGINAL FIGURE 7 AND THE REVISED FIGURE 7 ARE THAT CHANNELS 15 AND 16 ARE ENCODED WITH TWO BIT EACH THIS INCREASES THE FRAME RATE FROM 20 MILLISECONDS TO 20.8 MILLISECONDS

2400 BITS PER SECOND VOCODER TRANSMITTER

2400 BITS PER SECOND
VOCODER TRANSMITTER

2400 BITS PER SECOND VOCODER RECEIVER

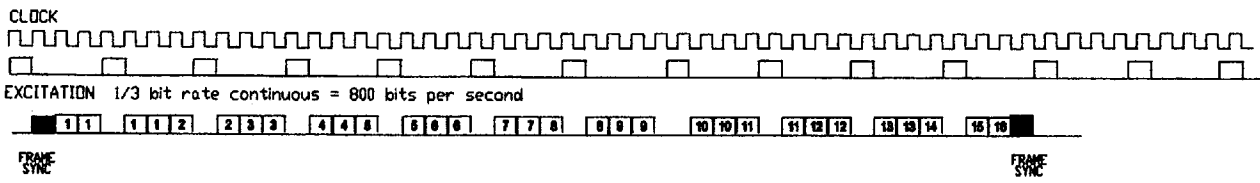

Each power spectrum band of frequencies is encoded using 4 bits each for their magnitude. The previous spectrum bands magnitude is compared with the next magnitude and the difference only is sent. Channel one uses the full four bits, channels 2 through 13 use the two most significant bits. Channels 14 through 16 use only one bit each.

2400 BITS PER SECOND TIMING

FIGURE 11 (ORIGINAL)

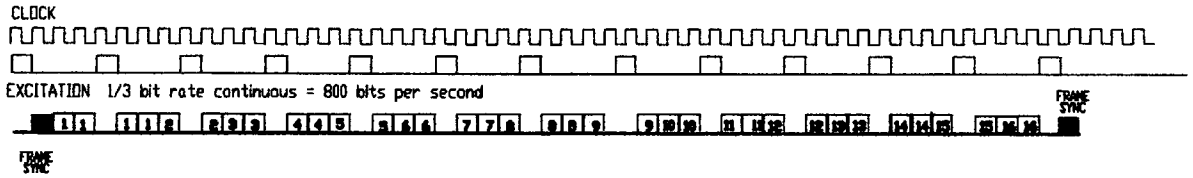

Each power spectrum band of frequencies is encoded using 4 bits each for their magnitude. The previous spectrum bands magnitude is compared with the next magnitude and the difference only is sent. Channel one uses the full four bits, channels 2 through 7 use the two least significant bits. Channel 8 is encoded using the three bits difference. Channels 9 through 16 are encoded using 2 bits difference

2400 BITS PER SECOND TIMING

FIGURE 11 (REVISED)

DIFFERENCE BETWEEN ORIGINAL-THE REVISED FIGURE 11 CHANGES CHANNEL 8 FROM 2 BITS ENCODING TO 3 BITS AND ADDS AN ADDITIONAL BIT TO CHANNELS 15 AND 16. THIS CHANGES THE FRAME RATE TO 22.5 MILLISENCONDS

SPECTRAL FLATTENER AND SPECTRAL GAIN RESTORATION (PRIOR ART)

Block Diagram of a Linear Predictive Vocoder using a voice/unvoiced decision and a Pitch Detector Block diagram of a Linear Predictive Vocoder using Voice Excitation with this Inventions Voice Excitation.

METHOD AND SYSTEM FOR LOW BIT RATE VOICE ENCODING AND DECODING APPLICABLE FOR ANY REDUCED BANDWIDTH REQUIREMENTS INCLUDING WIRELESS

BACKGROUND OF THE INVENTION

A vocoder is a speech analyzer and synthesizer. The human voice consists of sounds generated by the opening and closing of the glottis by the vocal cords, which produces a periodic waveform. This basic sound is then modified by the nose and throat to produce differences in pitch in a controlled way, creating the wide variety of sounds used in speech. There are another set of sounds, known as the unvoiced and plosive sounds, which are not modified by the mouth in said fashion.

The vocoder examines speech by finding this basic frequency, the fundamental frequency, and measuring how it is changed over time by recording someone speaking. This results in a series of numbers representing these modified frequencies at any particular time as the user speaks. In doing so, the vocoder dramatically reduces the amount of information needed to store speech, from a complete recording to a series of numbers. To recreate speech, the vocoder simply reverses the process, creating the fundamental frequency in an oscillator, and then passing it into a modifier that changes the frequency based on the originally recorded series of numbers.

Disadvantageously, the actual qualities of speech cannot be reproduced so easily. In addition to a single fundamental frequency, the vocal system adds in a number of resonant frequencies that add character and quality to the voice, known as the formant. Without capturing these additional qualities, the vocoder will not sound authentic.

In order to address this, most vocoder systems use what are effectively a number of coders, all tuned to different frequencies, using band-pass filters. The various values of these filters are stored not as raw numbers, which are all based on the original fundamental frequency, but as a series of modifications to that fundamental needed to modify it into the signal seen in the filter. During playback these settings are sent back into the filters and then added together, modified with the knowledge that speech typically varies between these frequencies in a fairly linear way. The result is recognizable speech, although somewhat "mechanical" sounding. Vocoders also often include a second system for generating unvoiced sounds, using a noise generator instead of the fundamental frequency.

Standard systems to record speech record a frequency from about 300 Hz to 4 kHz, where most of the frequencies used in speech reside, which requires 64 kbit/s of bandwidth, due to the Nyquist Criterion regarding sample rates for highest frequency. In digitizing operations, the sampling rate is the frequency with which samples are taken and converted into digital form. The Nyquist frequency is the sampling frequency which is twice that of the analog frequency being captured. For example, the sampling rate for high fidelity playback is 44.1 kHz, slightly more than double the 20 kHz frequency a person can hear. The sampling rate for digitizing voice for a toll-quality conversation is 8,000 times per second, or 8 kHz, twice the 4 kHz required for the full spectrum of the human voice. The higher the sampling rate, the closer real-world objects are represented in digital form.

Conventional low bit rate vocoders (below 4800 bits per second) use a decision process to determine if excitation is either voiced, e.g., vocal cords or unvoiced, e.g., hiss or white noise, and if voiced, a measure of the vocal pitch. The short term spectrum and the voiced pitch/unvoiced, is transmitted with a new frame approximately every 20 milliseconds via a digital link, and the reconstructed spectrum generator is excited by the pitch or white noise and speech is reproduced.

One of the disadvantages of conventional vocoders is the voice/unvoiced decision and accurate pitch estimation. For English speakers, voice quality is usually acceptable since the algorithms were developed using English speakers, but for other languages, these low bit rate vocoders do not sound natural. Higher bit rate voice excited vocoders do not require any voice/unvoiced decision or pitch tracking and preserve the intelligibility and speaker identification. The principle of operation is to encode the first formant speech band and use it to provide excitation input to the spectrum generator. Formant refers to any of several frequency regions of relatively great intensity in a sound spectrum, which together determine the characteristic quality of a vowel sound.

The vocal tract is characterized by a number of resonances or formants which shape the spectrum of the excitation function, typically three below 3000 Hertz. The first formant contains all components, both periodic (voiced) and non periodic (unvoiced) excitations.

The first formant is encoded using pulse code modulation (pcm), and then analyzing the remainder of the speech spectrum and transmitting the excitation and speech spectrum every 20-25 milliseconds. The received first formant is then decoded and is used as excitation for the spectrum generator to produce natural sounding speech. These vocoders typically use 8000 bits per second or more for natural sounding speech.

BRIEF SUMMARY OF THE INVENTION

4800 Bits per Second

The present invention uses voice excitation, eliminating the voice/unvoiced pitch tracking, and the first formant up to 2400 Hertz, does not use pulse code modulation encoding, but uses the zero crossings only of the first formant, dividing by two and sampling at 2400 Hertz. The resulting combination uses half of the bit rate for excitation and the remainder for short term spectrum analysis. The spectrum is updated 48 times per second using 50 bits per frame. This technique provides high intelligibility with good speaker recognition. The decoder extracts the excitation, multiplies it by two and uses a Hanning modified sawtooth and spectral flattening to excite the spectrum generator. This waveform produces both even and odd harmonics for both periodic (voiced) and aperiodic (unvoiced) frequencies and gives naturalness to all languages and speakers. An advantage of this technique is that telephone signaling (DTMF) is that encoding for the signal tones are passed through so that separate DTMF encoding and decoding and devices are not required. Other vocoders require additional circuitry to recognize DTMF and to regenerate the tones.

In the present invention, the power spectrum gain for each band of frequencies is 24 dB. The channel bandwidths for the short term spectrum is rectified and low pass filtered, then encoded using 4 bits for the power level. Because of the close correlation of the adjacent spectrum levels, a different type of spectrum frame encoding is used. The first 8 channels are transmitted using 4 bits each, the difference between channel 8 and 9 transmits 3 bits difference between the magnitudes. Channels, 10 through 16 use two bits difference from the previous, channels. Because of the limited dynamic range of the encoder analog to digital converter, an automatic gain control (AGC) is required for optimum performance. The AGC is digitally controlled, and is only permitted to adjust the gain during voiced speech. The update rate uses a 20 Hertz frequency. Voicing decision compares the lower speech frequency coefficients to the higher speech frequencies and if the lower frequencies energy is higher, then the AGC is permitted to adjust the gain. The AGC provides an additional 24 dB giving a total dynamic range equal to standard PCM Codec.

At the decoder, the excitation is demultiplexed, the excitation is multiplied by two and the pulses are converted to a Hanning modified sawtooth that is spectrally flattened to give equal amplitudes to all of the harmonics and used as excitation for the spectrum generator. The gain coefficients are decoded and used to synthesize the voice. The resultant synthesis sounds natural and the intelligibility is as good as a toll quality telephone line.

Although the description of the invention uses analog circuits and bandwidths to more easily describe voice excitation, the implementation can be easily realized using digital signal processing techniques and microprocessors or linear predictive spectral encoding and readily available conventional codecs.

2400 Bits Per Second

The 2400 bits per second vocoder of the present invention restricts the first formant to 300 to 1100 Hertz, and then translates the first formant down 300 Hertz to near zero frequency to 800 Hertz. It then uses the same technique of zero crossings and divides by two of the first formant, this gives a maximum of frequency of 400 Hertz. The sampling frequency then is ⅓ of the bit rate or 800 bits per second for the excitation. This leaves 1600 bits to encode the spectral information.

The spectrum frame rate is 22.5 milliseconds. The frequency amplitude spectrum is encoded using either a predictive short term frequency analysis, bandpass filter channels or a Fast Fourier Transform. If bandpass channels are implemented since the correlation between spectrum amplitude frequency analysis bands is good then a difference or delta encoding is used. The spectral information uses 36 bits per frame. The first spectral band is encoded using 4 bits for amplitude, bands 2 through 7 use a delta or difference encoding of 2 bits. Band 8 uses 3 bits delta encoding. Bands 9 through 16 use 2 bits delta encoding each, giving 35 bits per frame for spectral information and a one frame sync bit.

At the decoder, the excitation is demultiplexed, the excitation is passed through a 400 Hertz low pass filter; multiplied by two and frequency translated to 1100 Hertz where the zero crossings are converted to the Hanning modified sawtooth that is spectrally flattened and used as excitation for the spectrum generator.

BRIEF DESCRIPTION OF THE DRAWINGS

FIG. 7 is a timing diagram showing the excitation and channel spectrum framing for 4800 bits per second as used in the present invention.

FIG. 11 is the timing diagram for the excitation and spectrum framing for a 2400 bits per second channel vocoder of the present invention.

DETAILED DESCRIPTION OF THE INVENTION

Figure 1:
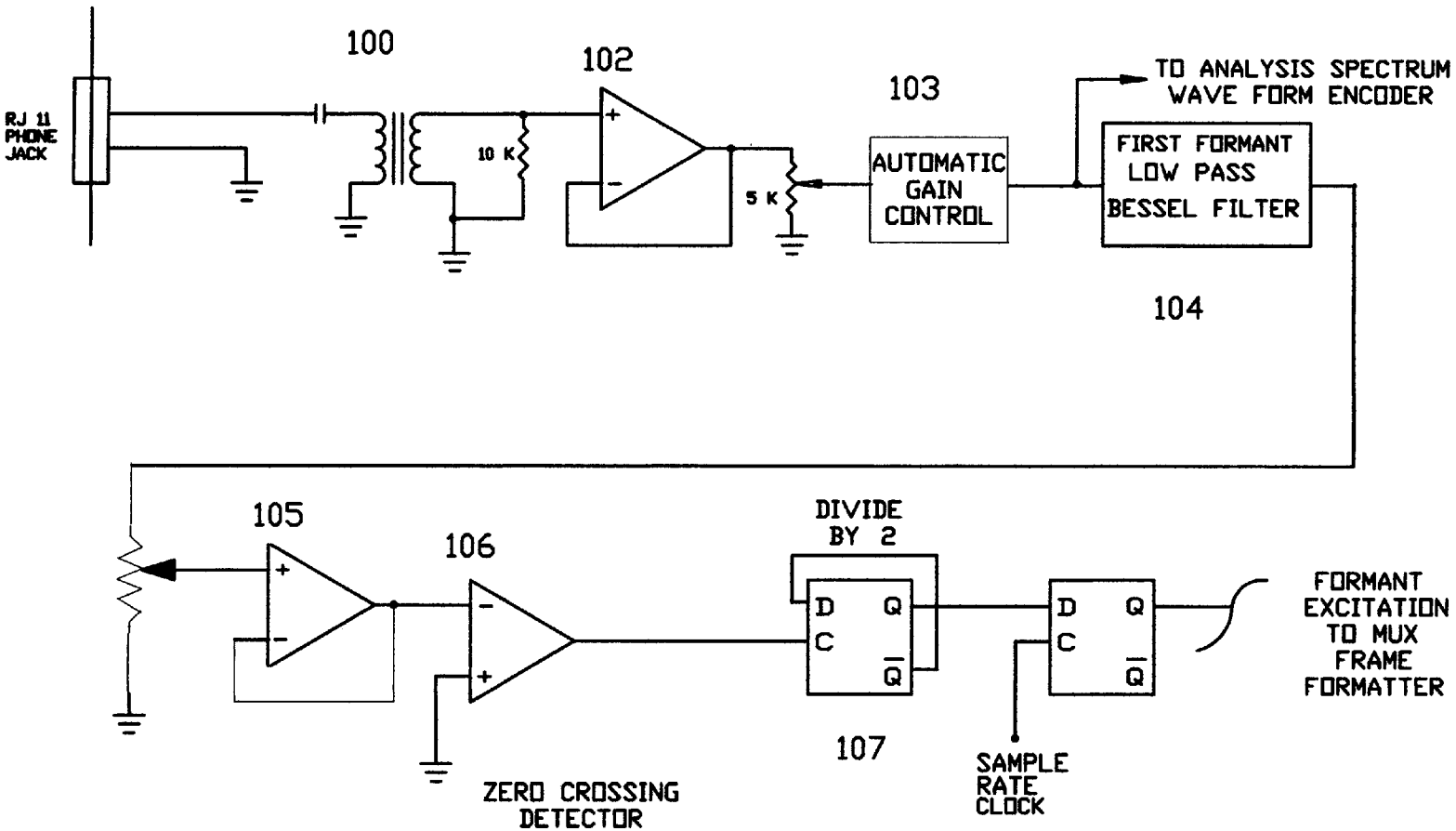
FIG. 1 is a block diagram of the first formant encoder excitation extraction and frequency divide by two operation for the 4800 bits per second vocoder implementation of the present invention.

FIG. 1 is a block diagram of the first formant encoder excitation extraction and frequency divide by two operation for the 4800 bits per second vocoder implementation of the present invention. As seen therein, transformer 100 isolates an audio input, such as a telephone line with a typical impedance of 600 ohms. The input could be a microphone or other type of speech input. Buffer amplifier 102 isolates the input from the device. Automatic gain control 103 adjusts the long term gain for each level of input. Automatic gain control 103, either a digital or analog device, also could be a device that uses only voiced (vocal tract) decisions to adjust the long term audio level. Anti-aliasing filter 104 removes frequencies higher than one half of the sampling rate. The filter response could be implemented as a Bessel filter or could also be implemented using other techniques such as elliptic function (Cauer) followed by an all pass to give a flat group delay. The envelope delay should be the same for all frequencies in the pass band. Variable gain device 105 consists of a potentiometer and a buffer amplifier and is used to set the level for zero crossing detector 106. Zero crossing detector 106 is referenced to zero volts and has an output that is compatible with the type of digital logic voltage levels. Zero crossings give basic excitation frequencies that are used to derive speech modeling. Bistable multivibrator 107 divides the basic zero crossing frequencies by two. Although a "D" flip flop 108 is shown, "JK" flip flops or other types can be used. "D" type register 108 is used to store the output of 107 and is clocked at the sample rate which is a sub multiple of the synchronous clock. The output of "D" flip flop 108 is sent to the multiplexer frame formatter where it is transmitted continuously as part of the data stream and is independent of the spectrum amplitude. As seen in FIG. 1, the filtering, zero crossing and divide by two and sampling at a sub multiple of the synchronous channel clock allows voice excitation to be sent at lower bit rates than other similar voice encoders.

Figure 2:
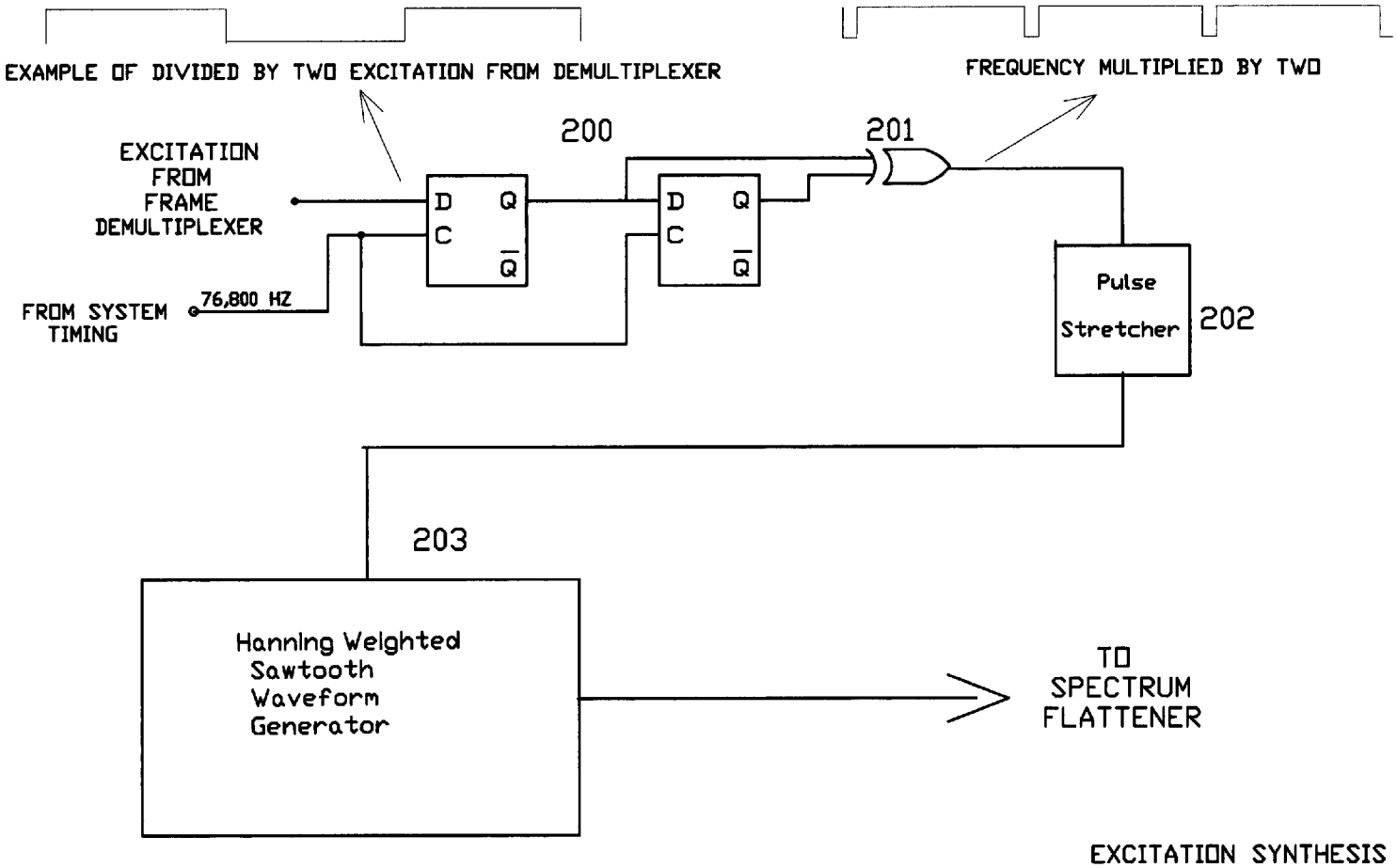
FIG. 2 is a block diagram of the decoder excitation and frequency multiplied by two operation for the first formant and the excitation weighting function for 4800 bits per second vocoder implementation of the present invention.
Figure 12:
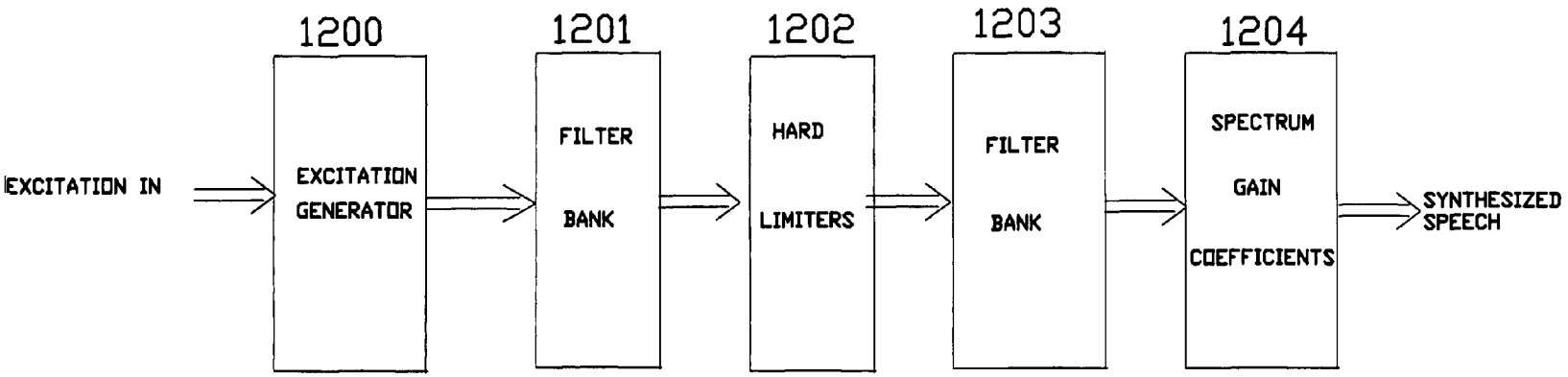
FIG. 12 shows a block diagram of a method of spectral flattening of the excitation in a channel vocoder of the present invention.

FIG. 2 is a block diagram of the decoder excitation and frequency multiplied by two operation for the first formant and the excitation weighting function for 4800 bits per second vocoder implementation of the present invention. As seen therein, excitation synthesis, the excitation divided by two is sent from the frame demultiplexer to "two bit" shift register 200 that could be either "D" or "JK" flip flop and clocked at a much higher rate than the data clock. The output from each register is connected to a device such as an "exclusive or" device 201 which gives an output at each edge either positive or negative and thus gives a frequency that is twice the input frequency which restores the original zero crossing frequencies. If analog detection is used, a differentiator with either the negative or positive peaks could be used. The output of the frequency multiplier, comprising "two bit" shift register 200 and "exclusive or" device 201 is then sent to pulse stretcher 202 which could be a one-shot multivibrator. The output of pulse stretcher 202 is then sent to a Hanning weighted sawtooth waveform generator 203 where the output from pulse stretcher 202 is used to generate a sawtooth waveform that is multiplied by a raised cosine or Hanning weighted function that also is modified to eliminate any direct current components. The sawtooth wave more closely models the vocal tract excitation and also includes both even and odd harmonics. The output is sent to a spectral flattener which gives equal amplitudes to all harmonics of the voice excitation. The spectral flattener is a key component of voice coding techniques, and can be constructed as shown in FIG. 12 or could be the outputs of a bank of filters with a fast attack automatic gain control, or the sign bit or most significant bit of an output of a digital filter.

Figure 3A:
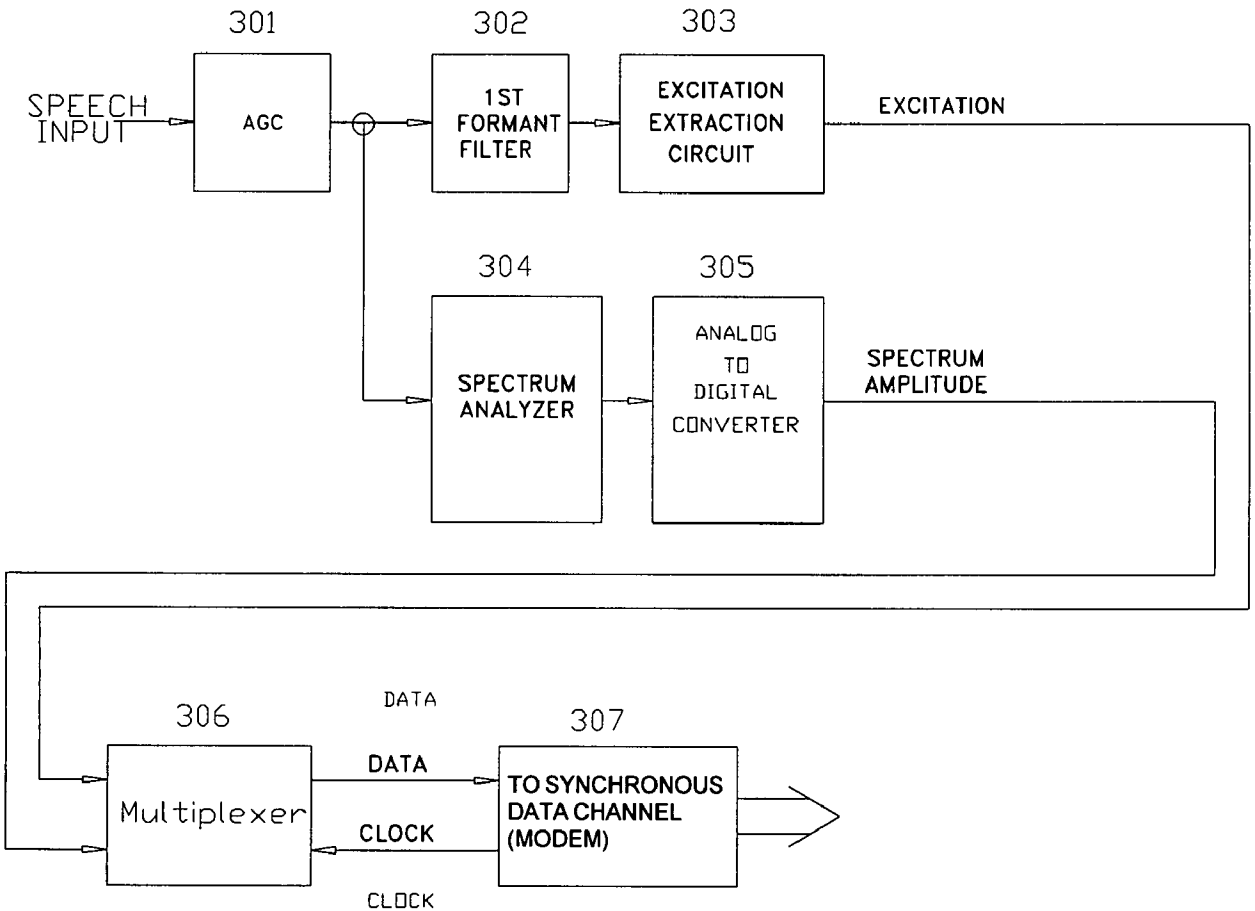
FIG. 3A is a block diagram of the 4800 bits per second vocoder transmitter implementation of the present invention using the first formant zero crossing and divide by two and non channel short term spectrum.

FIG. 3 provides a block diagram for a 4800 bits per second vocoder transmitter implementation of the present invention which could be a non-channel vocoder. Automatic gain control 301, which can be either digital or analog, adjusts the long term gain for each level of input. It also could be a device that uses only voiced (vocal tract) decisions to adjust the long term audio level. First formant filter 302 can be based upon a Bessel (flat envelope delay) realization and could be implemented as an analog or digital device. Circuit module 303 implements the excitation analysis of FIG. 1. Spectrum analyzer 304 provides a short term frequency spectrum for the typical telephone line bandwidth of 300 to 3000 Hertz. The output of the spectrum analyzer 304 is converted by ADC 305 into a 4 bit amplitude for either frequency bands or a linear predictive code. Multiplexer 306 combines the excitation and short term spectrum into a single data stream that is clocked by the synchronous data channel 307. Synchronous data channel 307 can be either a wireless or to a digital channel.

Figure 3B:
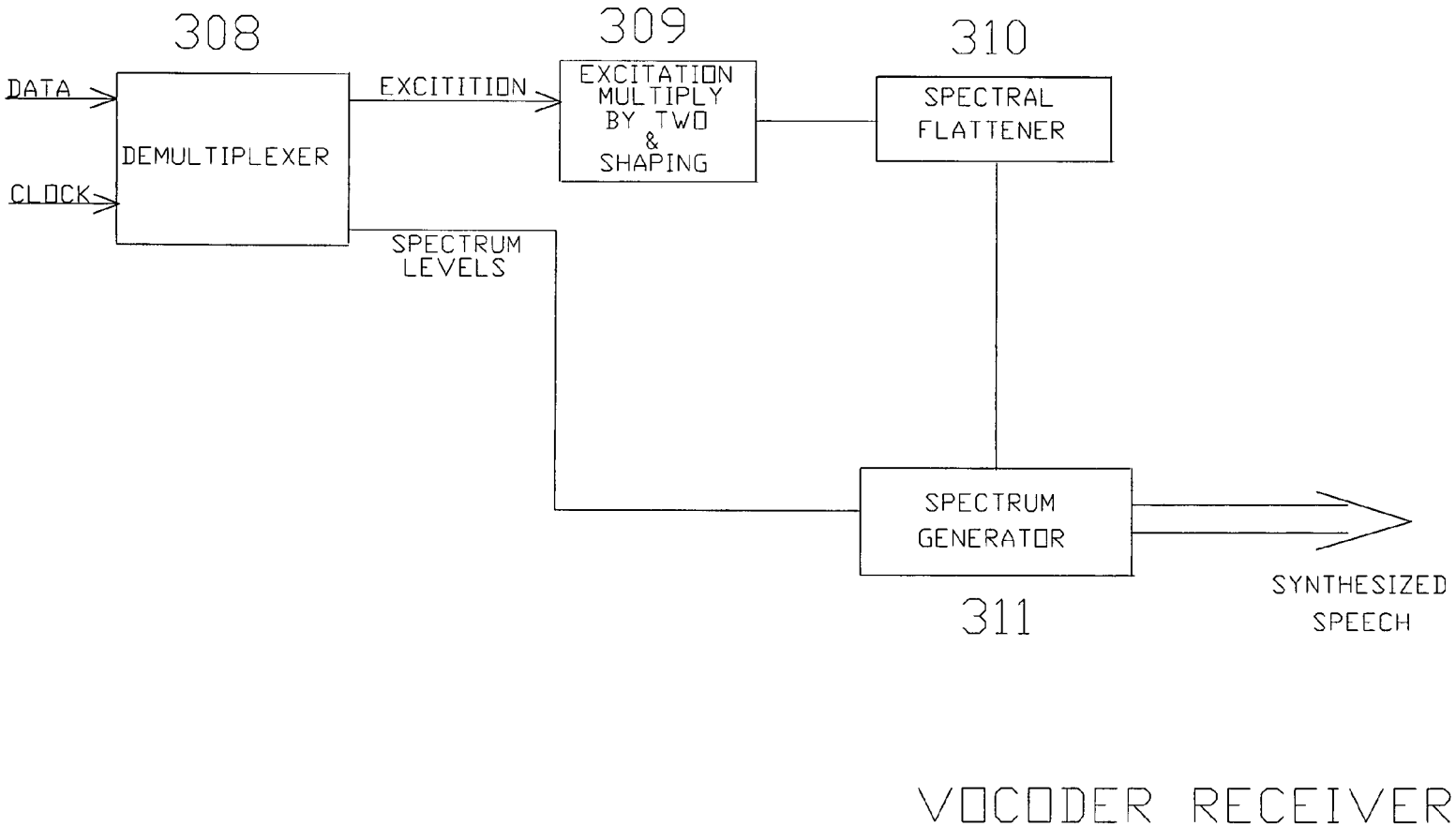
FIG. 3B is a block diagram of a 4800 bits per second vocoder receiver implementation of the present invention using the multiply by two excitation extraction and non channel short term spectrum operation.

FIG. 3B is a block diagram of a 4800 bits per second vocoder receiver implementation of the present invention using the multiply by two excitation extraction and non channel short term spectrum. The receiver is a 4800 bits per second vocoder receiver which could be a non-channel vocoder. Demultiplexer 308 separates the excitation from the short term spectrum weighting. Module 309 is adapted to perform the excitation synthesis shown in FIG. 2. Spectral flattener 310 flattens the spectrum to give equal amplitudes to all harmonics. Spectrum generator 311 takes the spectrum weighting excited by module 309 and synthesizes speech.

Figure 4:
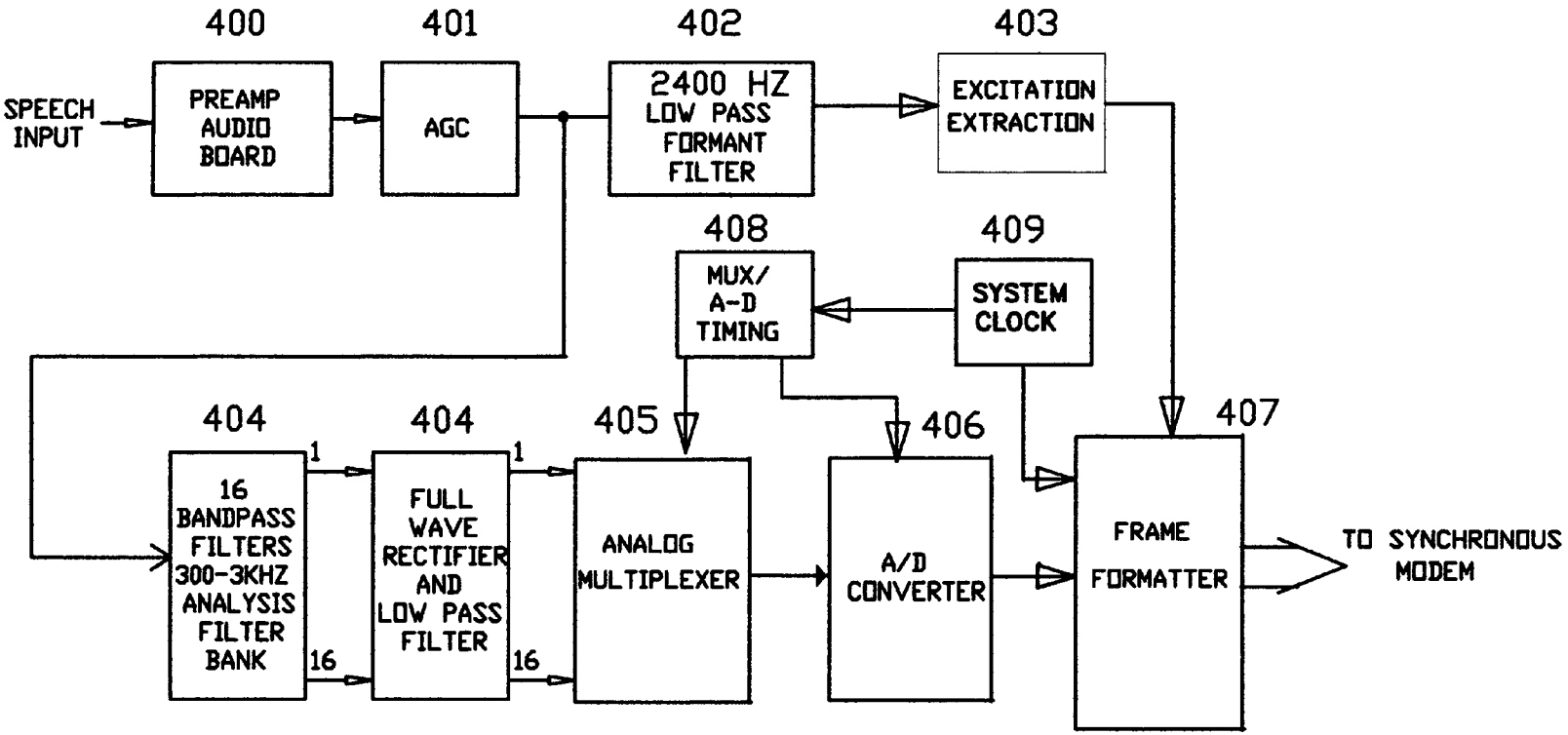
FIG. 4 is a block is a block diagram of the 4800 bits per second channel vocoder encoder implementation of the present invention using the first formant extraction, band pass filters, rectification and filtering and analog to digital conversion of the power spectral density and frame formatter.

FIG. 4 is a block is a block diagram of a 4800 bits per second channel vocoder implementation of the present invention illustrating the first formant excitation, channel filters, band pass spectrum power density, analog to digital conversion and multiplexing of the excitation and spectral power density to a synchronous modem channel. As seen therein, module 400 comprises a preamplifier and a band pass filter that limits the input frequencies to 300 Hertz to 3000 Hertz. Automatic gain control 401, either a digital or analog device, adjusts the long term gain for each level of input. Automatic gain control 401 could be a device that uses only voiced (vocal tract) decisions to adjust the long term audio level. 2400 Hertz low pass filter 402 has a Bessel flat delay response and is used to limit the frequencies to the excitation extraction module 403 (as seen as modules 106 through 108 in FIG. 1). Filter module 404 consists of 16 Bessel response band pass filters that give overlapping coverage from 300 Hertz to 3000 Hertz. Filter module 404 comprises 16 rectifiers and 16 low pass filters operable to provide a dc voltage that represents the power spectral density of each band pass. The low pass filter of filter module 404 comprises a first order low pass that is matched to the frame rate (40 Hertz). Multiplexer 405 sequentially switches between all 16 channels and controls the start of conversion for a four bit analog to digital converter 406. Each channel's four bit amplitude is stored in a register located in frame formatter 407. Channels 1 through 8 are encoded as the full 4 bits. Frame formatter 407 includes a 4 bit magnitude comparator that compares channel 8 and channel 9 and the 3 most significant bits are encoded. Channel 10 through 14 are compared using the difference between the previous channel and the two most significant bits are encoded. Channel 15 is compared with the four bit magnitude of channel 14 and two difference bits is encoded. Channel 16 is compared with channel 15 and two difference bits are encoded. The frames consist of 50 synchronization and 9 bits are used for spectrum levels. The frame rate is 48 frames per second as explained in the description of FIG. 7.

Figure 5:
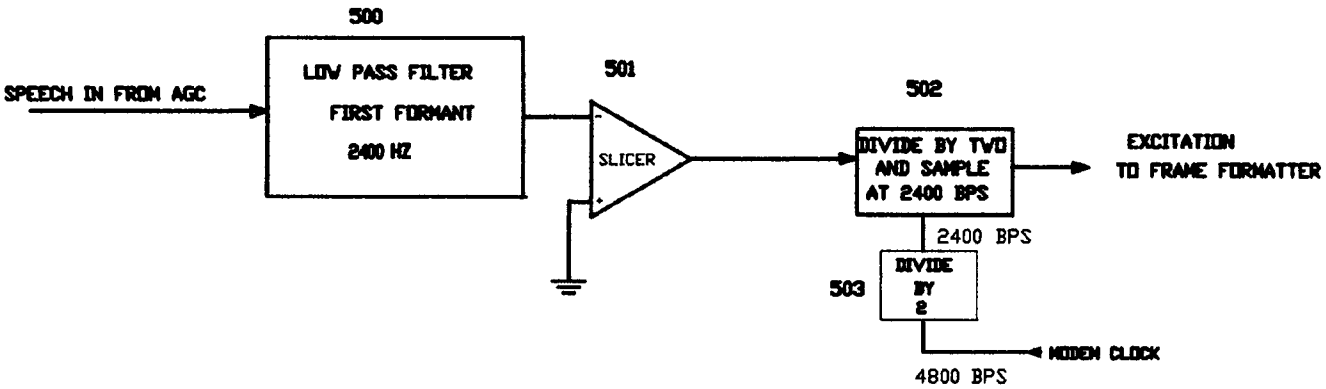
FIG. 5 is a block diagram showing the excitation extraction at 4800 bits per second and the modem clock divided by two to provide sampling of the zero crossings divided by two.

FIG. 5 is a block diagram illustrating the excitation extraction at 4800 bits per second and the modem clock divided by two operation which to provides sampling of the zero crossings divided by two. As seen therein, 2400 Hertz Bessel response low pass filter 500 is followed by zero crossing detector (also referred to as a slicer) 501 which compares the signal to zero volts. Module 502 comprises a divide by two digital flip flop and a digital "D" flip flop where the excitation clock is the modem or channel clock divided by two. The output is sent to the [frame formatter 407 as seen in FIG. 4. The excitation rate for a 4800 bits per second channel then is 2400 or ½ of the channel rate.

Figure 6:
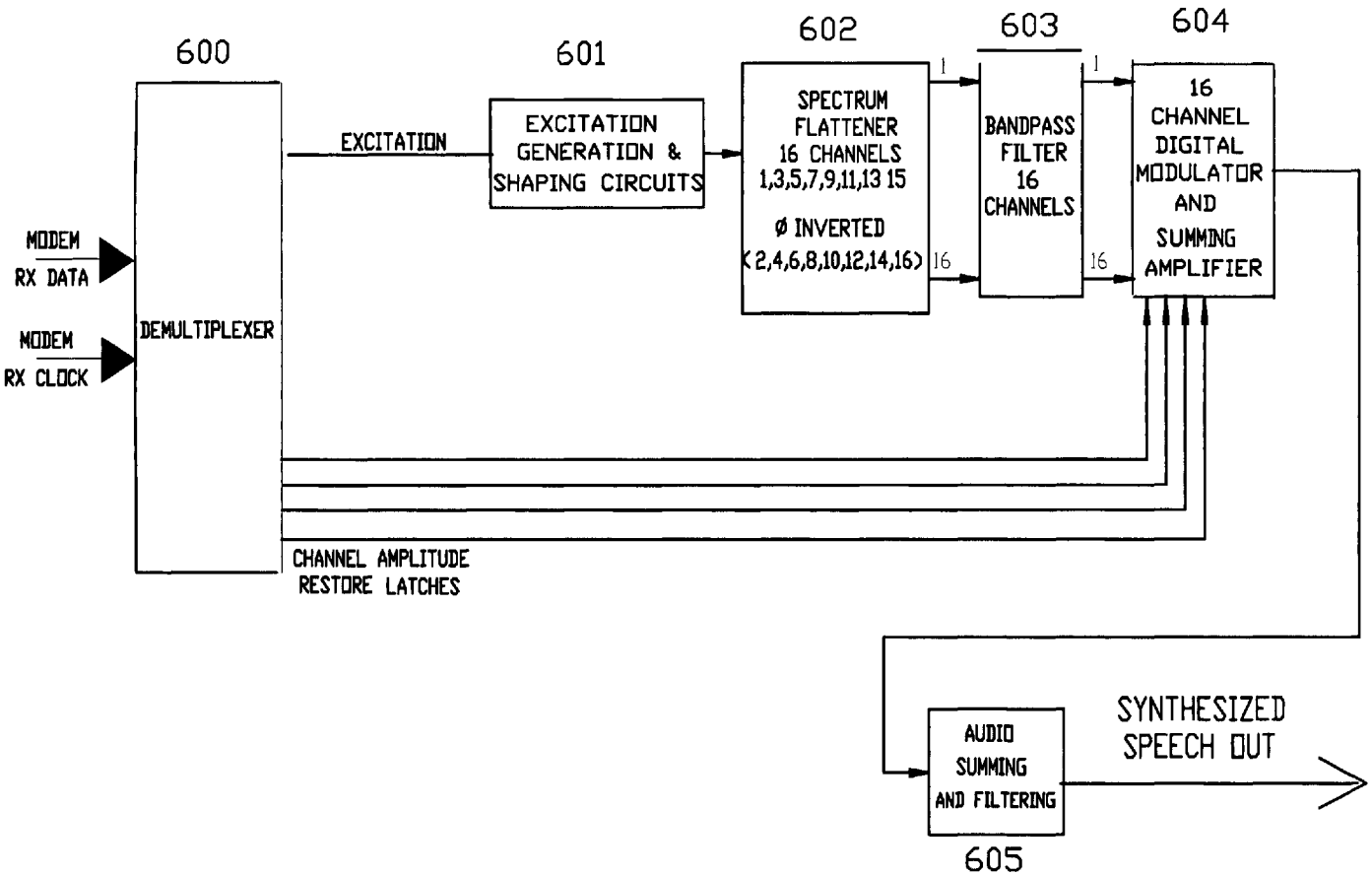
FIG. 6 is the block diagram for the 4800 bits per second voice excited channel vocoder receiver implementation of the present invention.

FIG. 6 is the block diagram for the 4800 bits per second voice excited channel vocoder receiver implementation of the present invention. As seen therein, demultiplexer 600 is a voice excited channel vocoder receiver or synthesizer that separates the excitation from the spectrum amplitude clock from a 4800 bits per second channel and sends the excitation delayed by one frame to "two bit" shift register 200 as seen in FIG. 2. Spectral flattener 602 is operable to give equal amplitude to all harmonics of the excitation. It can either consist of a bank of channel filters identical to the analyzer followed by hard limiters followed by an identical bank of filters 603, or can be simplified by using only a single bank of filters followed by 16 automatic gain control devices. Digital modulator 604 restores the synthesized frequencies from the spectral flattener and sends them to audio summing and filtering module 605 which sums them together to synthesize the speech.

FIG. 7 is a timing diagram showing the excitation and channel spectrum framing for 4800 bits per second. As seen therein, the clock from the channel (modem or wireless) is shown of line one and is labeled as clock. The clock samples the data which is the zero crossings divided by two (on the negative transitions) and transfers the data to the multiplexer. The excitation is every other data bit and is continuous and the sample rate is ½ the data rate of 4800 bits per second. The third line and fourth line shows the encoding for the spectrum. Bit zero is the frame synchronization bit and is used to synchronize the spectrum amplitudes and excitation for the different channels if band pass channels are used, linear prediction or residuals could also use the same format. 49 bits are used for the short term power spectrum encoding giving a frame of 50 bits which includes the synchronizing bit. The excitation is ½ of the data rate and is continuous, the spectral envelope is updated every 20.8 milliseconds.

Figure 8:
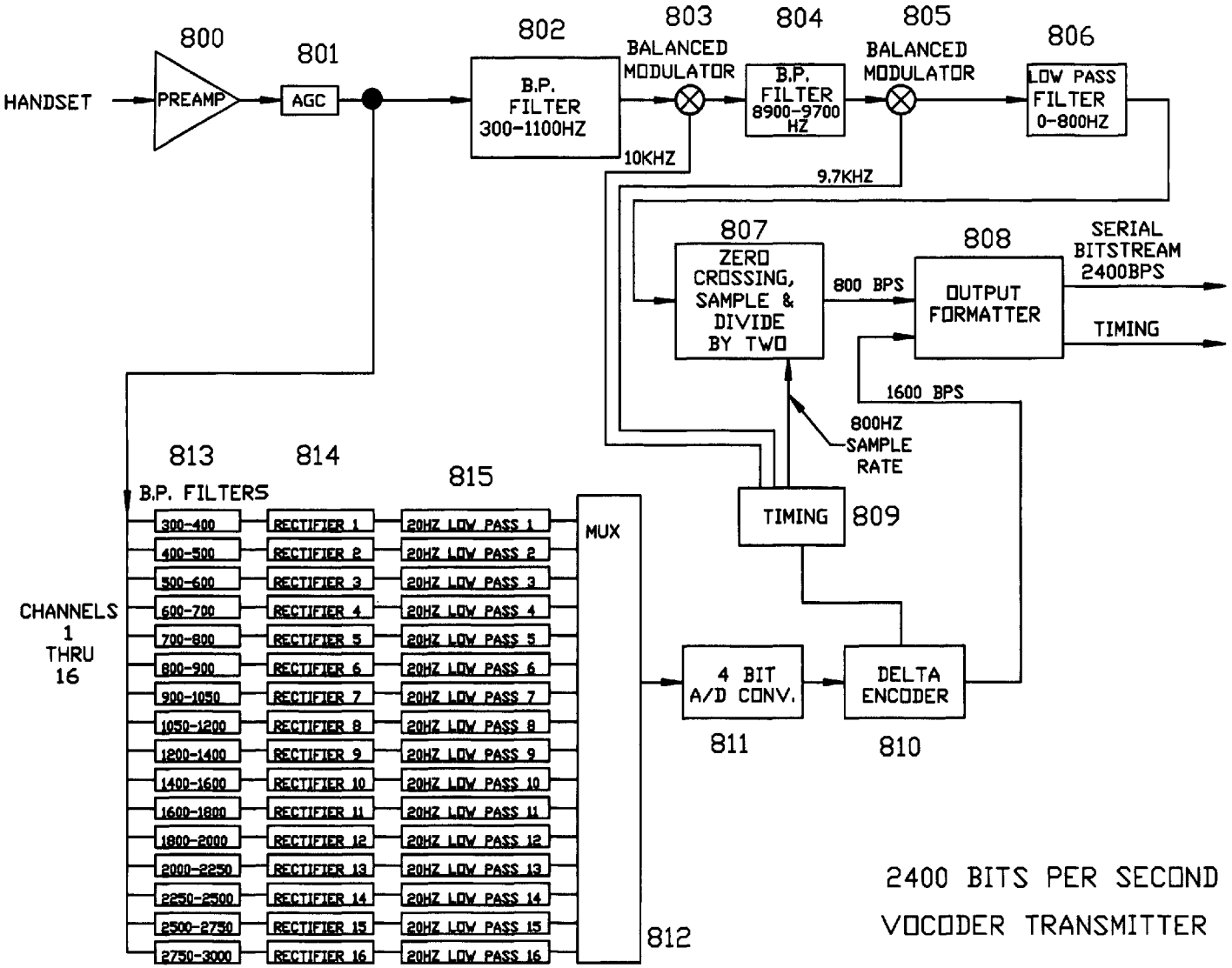
FIG. 8 is a block diagram of the 2400 bits per second channel vocoder transmitter implementation of the present invention using the first formant zero crossing and divide by two.

FIG. 8 is a block diagram of the 2400 bits per second channel vocoder transmitter implementation of the present invention using the first formant zero crossing and divide by two. As seen therein, the diagram shows frequency translation of the first formant (300 to 1100 Hertz) to zero to 800 Hertz, dividing by two and sampling at 800 Hertz for the excitation, and using a bank of band pass filter, rectifying lows pass filtering to give the power spectral density, converting the outputs to a four bit digital conversion, encoding the amplitude difference between channels, and multiplexing the excitation and spectral levels to provide a serial data output of 2400 bits per second. Preamplifier 800 is operable to condition the level of the voice input. Automatic gain control 801, either a digital or analog device, adjusts the long term gain for each level of input. It also could be a device that uses only voiced (vocal tract) decisions to adjust the long term audio level. Filter 802 is a 300 to 1100 Hertz low pass filter with a Bessel response. A first balanced modulator 803 is a double balanced modulator that cancels the 10 kHz and the 300 to 1100 Hertz inputs and gives both the sum and difference of the input frequencies. (8900 to 9700 Hertz, and 10300 to 11100 Hertz). Bandpass filter 804 is a band pass filter with a Bessel response and bandwidth of 8900 to 9700 Hertz. A second balanced modulator 805 generates the difference sideband of 0 to 800 Hertz which is filtered by Bessel response low pass filter 806. Module 807 (comprising zero crossing detector 106 and bistable multivibrator 107 of FIG. 1) divides the basic zero crossing frequencies by two and the sampled data at 800 Hertz is encoded by output formatter 808. Timing module 809 provides digital timing based on an oscillator frequency of 2.457600 Mega Hertz and synchronized with the clock from the channel. Bandpass filters 813 comprise a bank of 16 band pass filters with Bessel responses, whose outputs are converted by rectifiers 814 filters 815 to the power spectral density of the voice input. Multiplexer 812 is an analog multiplexer that allows converter 811, a four bit analog to digital converter to change to analog outputs to digital. Encoder 810 is a delta encoder that uses the channel to channel correlation of the short term power spectrum to send after channel one, only difference codes to output formatter 808, as further described in FIG. 11.

Figure 9:
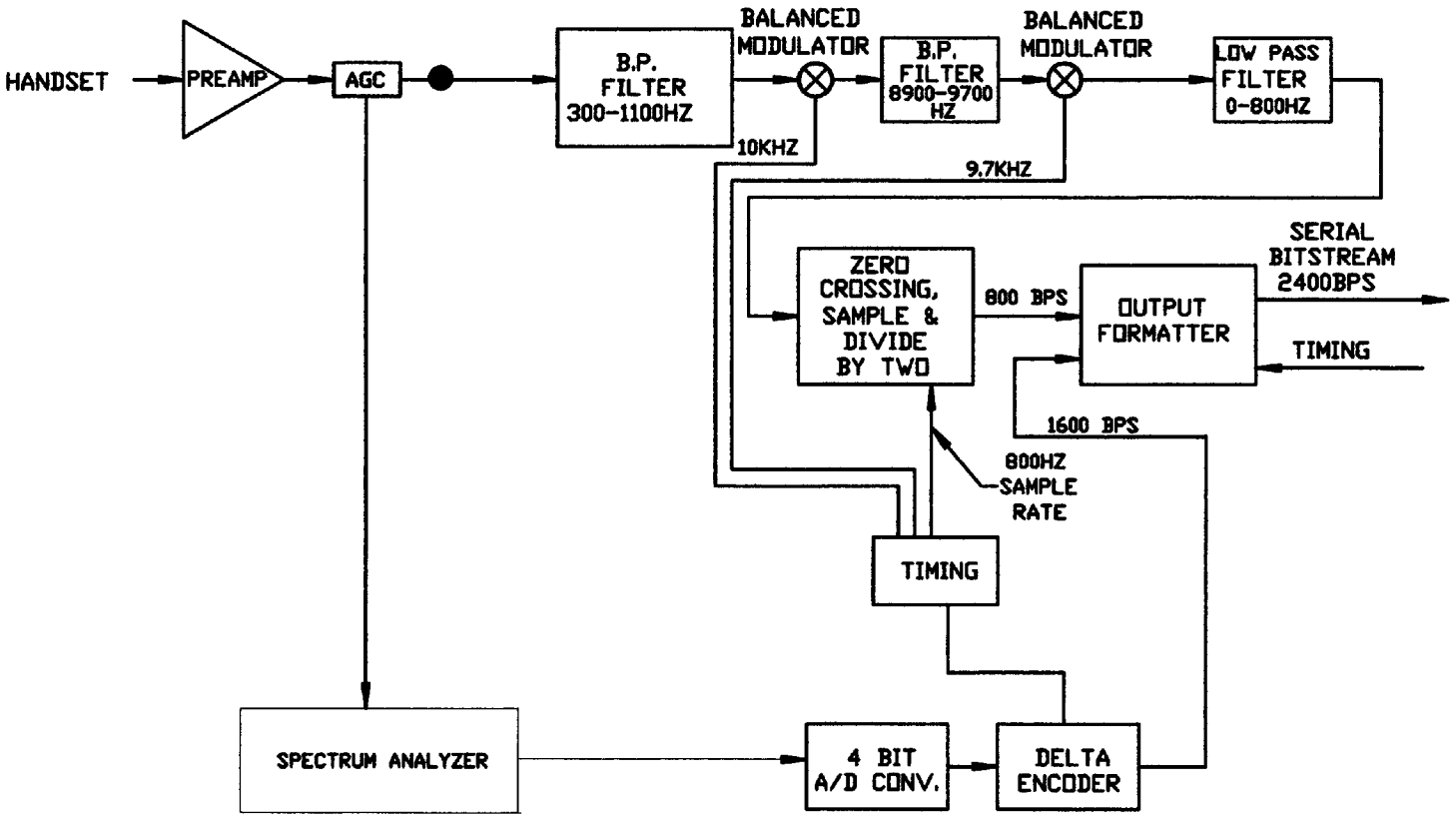
FIG. 9 is a block diagram of a 2400 bits per second vocoder transmitter implementation of the present invention using the excitation and translation, but a non channel spectrum analyzer.

FIG. 9 is a block diagram of a 2400 bits per second vocoder transmitter implementation of the present invention using the excitation and translation, but a non channel spectrum analyzer. As seen therein, this block diagram shows an example of a 2400 bits per second vocoder using other than band pass filters to encode the short term power spectrum. The frequency translation and excitation is the same as in FIG. 8.

Figure 10:
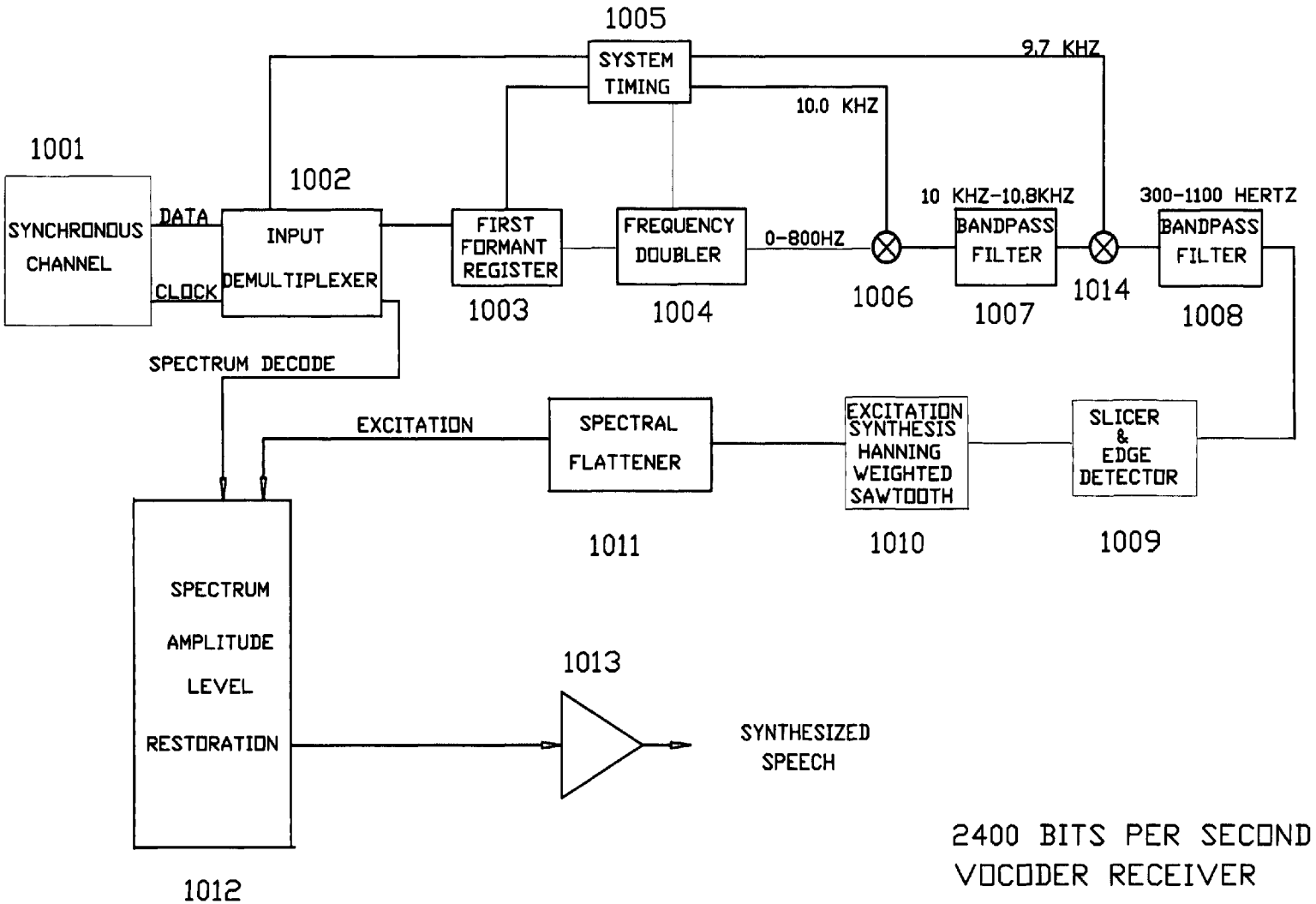
FIG. 10 is a block diagram of a 2400 bits per second vocoder receiver implementation of the present invention using frequency translation and excitation.

FIG. 10 is a block diagram of a 2400 bits per second vocoder receiver implementation of the present invention using frequency translation and excitation. Channel 1001 could be a synchronous wireless or radio modem or a wired channel. Demultiplexer 1002 takes the serial data and separates excitation and power spectrum encoding. Register 1003 stores the serial excitation and outputs it to frequency doubler 1004 which doubles the frequency using the same technique as described in the discussion of FIG. 2. The output of frequency doubler 1004 is an input to a first balanced modulator 1006 which is a double balanced modulator with a multiplying frequency of 10 kiloHertz. Filter 1007 is a Bessel response band pass filter with a bandwidth of 10 to 10.8 kilo Hertz. The lower sideband of 10 to 10.8 kilohertz is selected and sent to a second balanced modulator 1014 which is also a double balanced modulator with a multiplication frequency of 9.7 kilo Hertz. The lower sideband (300 to 1100 Hertz) is then filtered by item 1008 a band pass filter with Bessel response where the output is passed to item 1009 which takes the zero crossings which are then changed by module 1010 to a sawtooth waveform that is modified by a Hanning weighting which removes and DC components and gives both even and odd harmonics which then goes to spectral flattener 1011 which gives flat amplitudes to all excitation frequencies. Module 1012 restores the original spectrum using the same encoding/decoding as further described by FIG. 11. The outputs are summed and the synthesized speech is provided to amplifier 1013, the output sound amplifier. System timing module 1005 times the system based on an oscillator frequency of 2.457600 MegaHertz.

FIG. 11 is a timing diagram for 2400 bits per second, showing the 2400 bits per second clock, the excitation which is at ⅓ of the data and is continuous at 800 bits per second. As seen therein, the framing for the spectrum has a synchronization bit, followed by channel one encoded at the full four bits. Channels 2 through 7 are differentially encoded using two bits. Channel 8 is encoded using 3 bits differential from the 4 bits channel amplitude of channel 7. Channels 9 through 16 are encoded using 2 bits differential from the previous channels spectrum amplitude. The frame rate is 22.5 milliseconds for the spectrum weighting, Each frame consists of 36 bits which includes the frame synchronization bit.

FIG. 12 shows one implementation of a spectral flattener used to give a flat spectrum for all harmonics. Excitation generator 1200, as further described in FIG. 2, is coupled to a first channel filter bank 1201. The output of first channel filter bank 1201 is coupled to hard limiters 1202. The output of hard limiters 1202 is received at a second channel filter bank 1203 which is substantially identical to first channel filter bank 1201. This gives sinusoidal equal amplitude frequencies with the gain derived from the spectral encoded channels.

An alternate implementation comprises excitation generator item 1200 used to excite a first channel bank 1201, an automatic gain control on the output of each channel filter 1201, the output of channel filter 1201, then being applied to module 1204 which restores the original short term spectrum.

Figure 13:
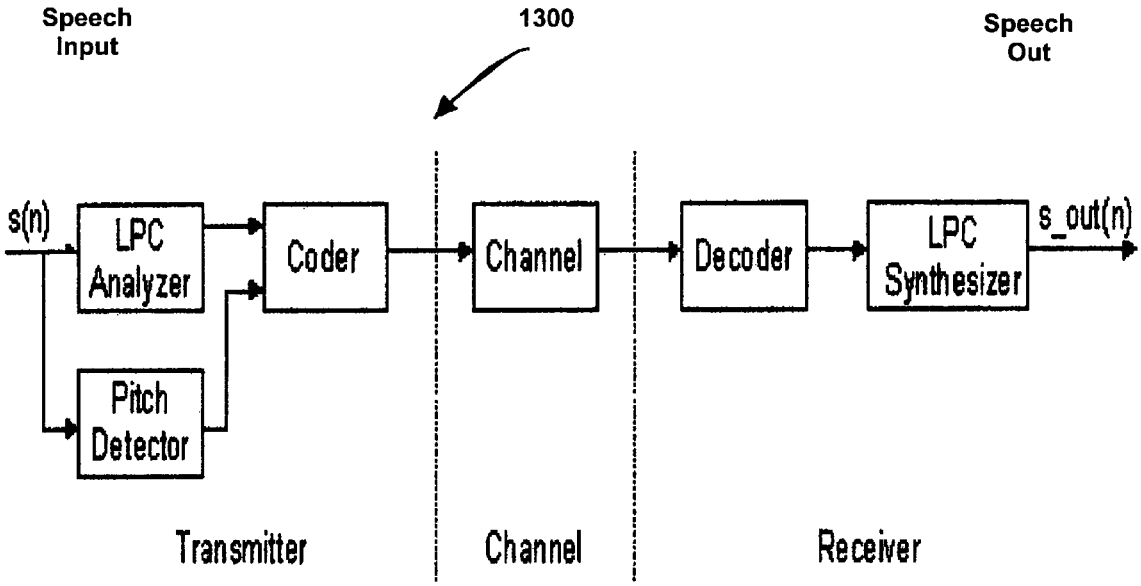
FIG. 13 shows a block diagram of a Linear Predictive Coded Vocoder using conventional voice/unvoiced decision and pitch tracking.
Figure 14:
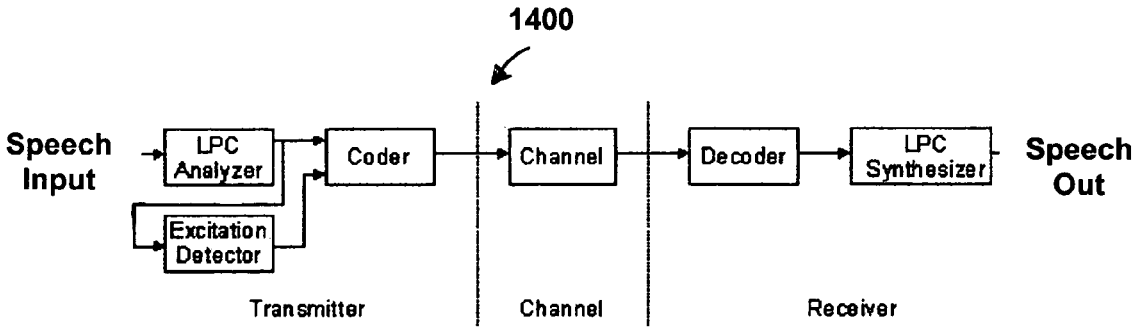
FIG. 14 shows a block diagram of a Linear Predictive Coded Vocoder using-voice excitation.

FIG. 13 shows a conventional block diagram 1300 of a voice/unvoiced pitch excited Linear predictive vocoder and FIG. 14 shows a block diagram 1400 of a voice excited vocoder using the method of voice excitation of the present invention.

The innovative teachings of the present invention are described with particular reference to analog circuits and bandwidths to more easily describe voice excitation. However, it should be understood and appreciated by those skilled in the art that the embodiments described herein provides only a few examples of the innovative teachings herein. Various alterations, modifications and substitutions can be made to the method of the disclosed invention and the system that implements the present invention without departing in any way from the spirit and scope of the invention. For example, the implementation can be easily realized using digital signal processing techniques and microprocessors, or Linear Predictive techniques and readily available conventional codecs.

What is claimed is:

1. A method of encoding and decoding a voice, comprising:

using voice excitation to trigger zero-crossings of the first formant at a transmitter;

outputting a digital waveform therefrom;

frequency dividing the resulting digital waveform by two to reduce the sampling rate and the bandwidth required for transmission;

producing, by a spectrum analyzer, a short term spectrum using an input voice;

weighting the short term spectrum;

generating a short term spectral frame;

creating a multiplexed waveform by multiplexing the voice excitation continuously with the short term spectral frame;

sending the multiplexed waveform from a transmitter to a receiver;

demultiplexing the multiplexed voice excitation and short term spectrum at the receiver;

frequency multiplying the demultiplexed voice excitation by two at the receiver;

spectrally flattening the excitation to give equal magnitude to all harmonics at a receiver; and using the spectrally flattened harmonics as excitation for a short term spectrum to reproduce an inputted voice.

2. The method of claim 1, further comprising obtaining the short term spectral weighting using a linear predictive speech processor analyzer.

3. The method of claim 1, further comprising channel bank band pass filtering to obtain the short term spectrum at the transmitter and the receiver.

4. The method of claim 1, further comprising applying a fast Fourier transform to obtain a digital short term spectrum.

5. A method of voice encoding and decoding, comprising:

heterodyning the first formant from 300 to 1100 Hertz to DC to 800 Hertz and using a zero crossing detector;

obtaining a zero crossing digital waveform;

frequency dividing the zero crossing digital waveform by two to reduce the sample rate and the bandwidth required for transmission;

producing, by a spectrum analyzer, a short term spectrum using an input voice;

weighting a short term spectrum;

multiplexing the digital waveform and short term spectrum;

sending the multiplexed waveform from a transmitter to a receiver; demultiplexing the multiplexed voice excitation and short term spectrum;

frequency multiplying the demultiplexed voice excitation by two and heterodyning the 0 to 800 Hertz to 300 to 1100 Hertz, spectrally flattening the excitation to give equal magnitude to all harmonics;

using the spectrally flattened harmonics as excitation to generate the short term spectrum; and reproducing a voice.

6. The method of claim 5, further comprising using a linear predictive speech processor analyzer for the short term spectral weighting.

7. The method of claim 6, further comprising using a channel bank band pass filter analyzer for the short term spectrum amplitude.

8. A system for encoding and decoding a voice, comprising:

an encoder means adapted to:

use voice excitation to trigger zero-crossings of the first formant;

output a digital waveform therefrom;

frequency divide the resulting digital waveform by two to reduce the sampling rate and the bandwidth required for transmission;

produce, by a spectrum analyzer, a short term spectrum using an input voice;

weight the short term spectrum;

generate a short term spectral frame;

create a multiplexed waveform by multiplexing the voice excitation continuously with the short term spectral frame; and a decoder means adapted to:

demultiplex a multiplexed voice excitation;

frequency multiply the demultiplexed voice excitation by two;

spectrally flatten the excitation to give equal magnitude to all harmonics; and use the spectrally flattened harmonics as excitation for a short term spectrum to reproduce an inputted voice.

9. The system of claim 8, wherein the encoding means comprises:

an automatic gain control (AGC) module;

a first formant filter;

an excitation module operable to implement an excitation analysis;

a spectrum analyzer module adapted to provide a short term frequency spectrum;

an ADC coupled to the output of the spectrum analyzer module;

a synchronous data channel; and a multiplexer operable to combine the outputs from the excitation module and spectrum analyzer module into a single data stream that is clocked by the synchronous data channel.

10. The system of claim 9, wherein the spectrum analyzer module is adapted to provide a short term frequency spectrum in a bandwidth of between approximately 300 to 3000 Hertz.

11. The system of claim 9, wherein the output of the spectrum analyzer module is converted by the ADC into a 4 bit amplitude for either frequency bands or a linear predictive code.

12. The system of claim 9, wherein the synchronous data channel is a wireless channel.

13. The system of claim 9, wherein the synchronous data channel is a digital channel.

14. The system of claim 9, wherein the receiver further comprises: a module to frequency multiply by two excitation extraction and non channel short term spectrum.

15. The system of claim 8, wherein the decoder means comprises:

a demultiplexer operable to separate the excitation from the short term spectrum weighting;

an excitation synthesis module adapted to perform an excitation synthesis;

a spectral flattener module operable to flatten the spectrum to give substantially equal amplitudes to all harmonics; and a spectrum generator operable to process the spectrum weighting excited by the excitation synthesis module and synthesize speech.

16. The system of claim 15, wherein such decoder means is a non channel vocoder.

17. The system of claim 8, operable to encode and decode a voice, at 2400 bits per second.

18. The system of claim 8, operable to encode and decode a voice, at 4800 bits per second.

* * * * *